US005095999A

United States Patent [19]

Markel

[11] Patent Number: 5,095,999

[45] Date of Patent: Mar. 17, 1992

[54] THROUGH TUBING PERFORATING GUN INCLUDING A PLURALITY OF PHASED CAPSULE CHARGES MOUNTED ON A RETRIEVABLE BASE STRIP VIA A PLURALITY OF SHATTERABLE SUPPORT RINGS

[75] Inventor: Daniel C. Markel, Houston, Tex.

[73] Assignee: Schlumberger Technology Corporation, Houston, Tex.

[21] Appl. No.: 563,657

[22] Filed: Aug. 7, 1990

[51] Int. Cl.[5] ..... E21B 43/116

[52] U.S. Cl. ..... 175/4.6; 102/310; 102/320; 102/321

[58] Field of Search ..... 175/4.6, 4.57; 102/310, 102/320, 321, 331

[56] References Cited

U.S. PATENT DOCUMENTS

| | | | |
|---|---|---|---|
| 2,756,677 | 7/1956 | McCullough | 102/310 |
| 2,764,938 | 10/1956 | Harcus | 175/4.6 |
| 2,833,214 | 5/1958 | Spencer | 175/4.6 |
| 3,078,797 | 2/1963 | Blair | 175/4.6 |
| 3,636,875 | 1/1972 | Dodson | 102/310 |
| 4,312,273 | 1/1982 | Camp | 175/4.6 X |
| 4,326,462 | 4/1982 | Garcia et al. | 102/310 |
| 4,393,946 | 7/1983 | Pottier et al. | 175/4.6 |
| 4,496,008 | 1/1985 | Pottier et al. | 175/4.6 |
| 4,543,703 | 10/1985 | Wetzel et al. | 102/310 X |
| 4,598,775 | 7/1986 | Vann et al. | 175/4.6 |
| 4,694,754 | 9/1987 | Dines et al. | 102/310 |
| 4,951,744 | 8/1990 | Rytlewski | 102/320 X |

OTHER PUBLICATIONS

Encyclopedia/Handbook, "Materials, Parts and Finishes", H. R. Clauser, 1984 edition, pp. 15–20.

Metals Handbook (Ninth Edition)-vol. 2, "Properties and Selection: Nonferrous Alloys and Pure Metals", 1979 edition, pp. 123–139.

*Primary Examiner*—Stephen J. Novosad

*Attorney, Agent, or Firm*—Henry N. Garrana; John H. Bouchard

[57] ABSTRACT

A through-tubing perforating gun includes an angularly shaped base strip having first and second surfaces and including a plurality of recesses in the first surface and a plurality of recesses in the second surface. A plurality of capsule charges are mounted in the plurality of recesses in the first and second surfaces of the base strip and are held in place within the recesses by a plurality of support rings connected to the base strip. The base strip is made of a material which will allow the base strip to withstand detonation of the capsule charges and will not shatter when the charges detonate; however, the support rings are made of a material which will allow the support rings to shatter when the capsule charges detonate. As a result, when the charges detonate, the support rings will shatter into a multitude of pieces allowing the charges to fall to a bottom of the well; however, the base strip will not shatter when the charges detonate and may be retrieved from the borehole for subsequent inspection to determine which charges detonated and which charges did not detonate.

7 Claims, 5 Drawing Sheets

FIG. 5
(PRIOR ART)
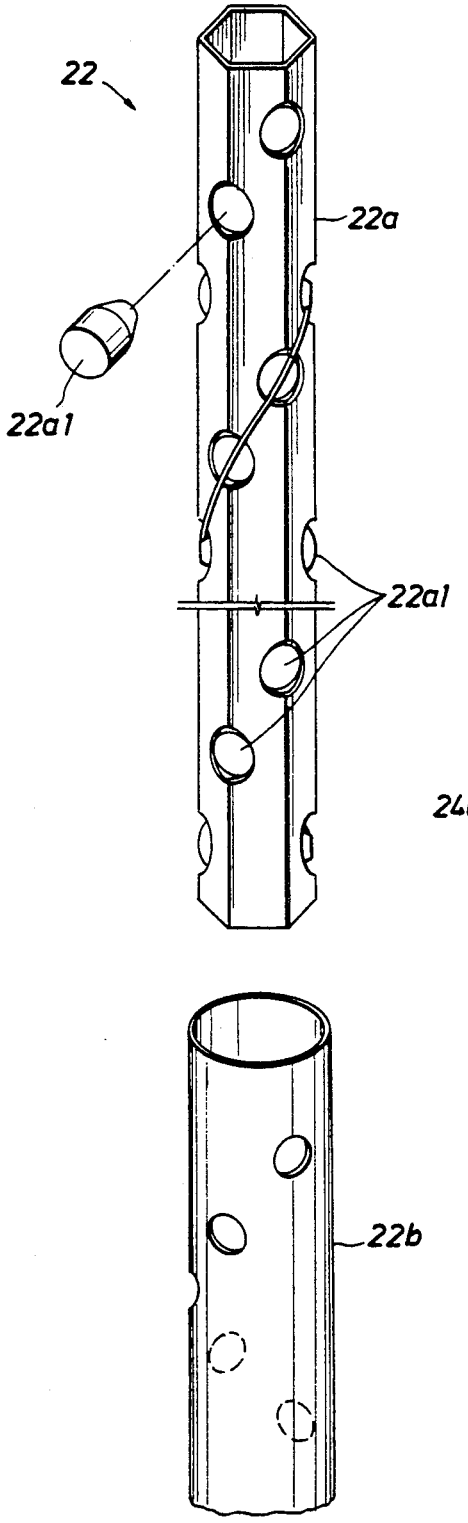
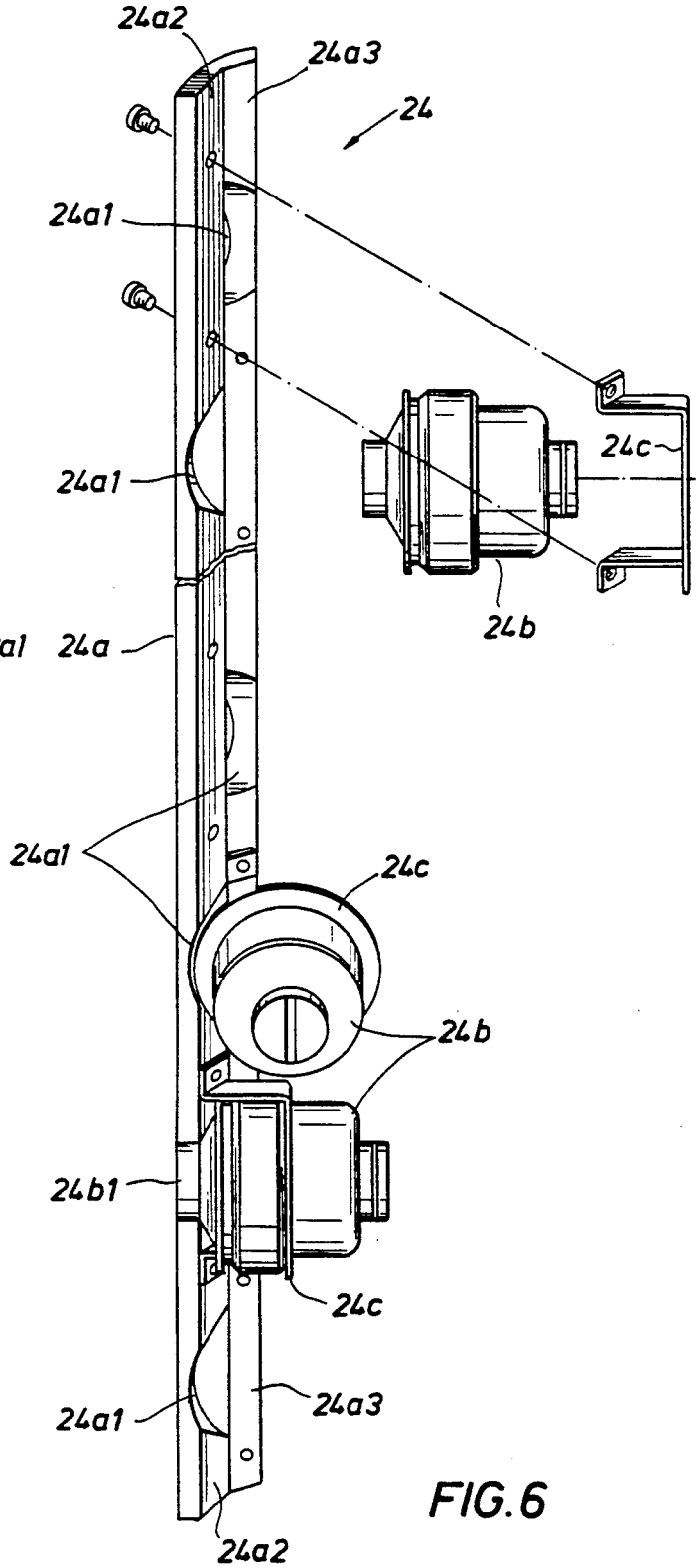
FIG. 6

FIG.7a
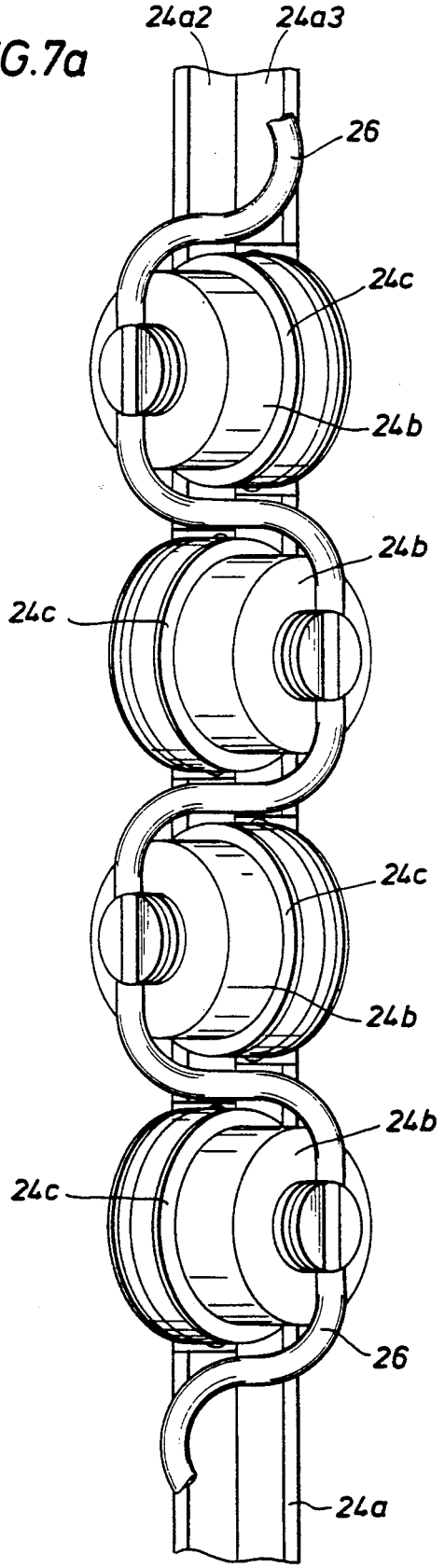
FIG.7b
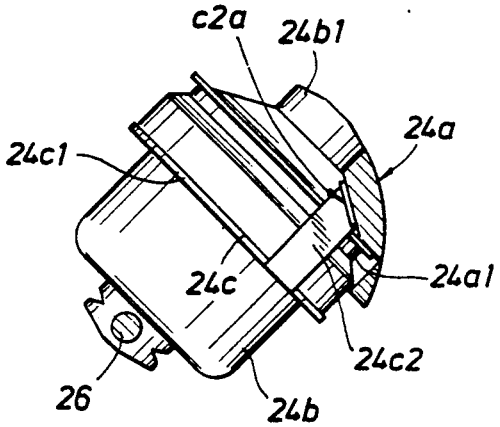
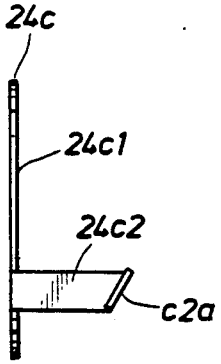
FIG.7c

THROUGH TUBING PERFORATING GUN INCLUDING A PLURALITY OF PHASED CAPSULE CHARGES MOUNTED ON A RETRIEVABLE BASE STRIP VIA A PLURALITY OF SHATTERABLE SUPPORT RINGS

BACKGROUND OF THE INVENTION

The subject matter of the present invention relates to through tubing perforating guns, and more particularly, to a through tubing perforating gun which includes a plurality of phased capsule charges mounted on a single, rigid unitary structure, via a respective plurality of support rings, the structure having an angular cross section and being comprised of a material which will not shatter when the phased capsule charges detonate, the support rings being designed to shatter when the capsule charges detonate.

Perforating guns, used in oil well boreholes for perforating a formation, are comprised of charges mounted on a base structure. The charges are often phased, that is, pointed in different directions, for perforating along a 360 degree circumference of the borehole. Of course, the charges are often not phased. In either case, the charges are mounted on a base strip. The charges may be capsule charges, that is, sealed against ambient pressure, or they may be normal, non-capsule charges, that is, not sealed against such ambient pressure. In the non-phased capsule charge situation, the charges perforate the formation in one direction only. In the phased capsule charge situation, the base strip is often a set of wires or a plurality of tubes connected together by a corresponding plurality of cotter pins. When the phased capsule charges are moving downhole, the wires or cotter pins often break when the charges hit an obstruction in the tubing. In addition, some phased charges are mounted on a straight bar, and a detonating cord is run longitudinally through or around the bar for connection to the charges. While the bar may be rigid enough to withstand an impact with the obstruction in the tubing, the straight bar configuration requires an increased diameter perforating gun relative to other such non-phased capsule charge perforating guns. Therefore, the straight bar, phased charge prior art gun cannot fit within the same tubing string that is used with respect to the non-phased charge perforating gun. One prior art perforating gun, similar to the straight bar, phased charge perforating gun discussed above, is found in U.S. Pat. No. 4,543,703 to Wetzel et al. In this patent, a base carrier, cross sectionally shaped in the form of a polygon, has a plurality of shape charges affixed thereto, a subset of the plurality of charges being fixed to each of the sides of the polygon shaped carrier. The perforating gun of the Wetzel patent appears to be very similar in configuration to the straight bar, phased charge perforating gun (illustrated in FIG. 3 of the drawings). Wetzel suffers from the same disadvantage that is possessed by the straight bar, phased charge perforating gun of FIG. 3; that is, the diameter of the Wetzel gun is increased relative to the diameter of the non-phased charge perforating gun (shown in FIG. 4). Consequently, the gun of the Wetzel patent cannot fit into the same tubing string that is used with respect to the non-phased charge perforating gun. Furthermore, it is possible to utilize non-capsule charges (charges not sealed against adverse ambient pressures) in perforating guns and phase the non-capsule charges; however, when using the non-capsule charges, a carrier is required to surround and protect the non-capsule charges from the hostile ambient fluids, temperatures and pressures often found in a borehole of a oil well.

Therefore, since all the above referenced prior art designs are deficient in some manner, a new perforating gun was designed by applicant whereby capsule charges are used thereby providing good penetration of the formation and eliminating the need for carriers, and such capsule charges are phased without requiring an increase in the diameter of the perforating gun in which the charges are mounted relative to other non-phased charge perforating guns; the new perforating gun is fully disclosed in prior application Ser. No. 07/394,782, filed Aug. 16, 1989, and now U.S. Pat. No. 4,951,744, entitled "Angularly Shaped Unitary Structured Base Strip Comprised of a Specific Material adapted for Phasing Charges in a Perforating Gun", the disclosure of which is incorporated by reference into this specification. In the new perforating gun of the prior application, the capsule charges must be mounted on a base strip which is rigid enough to avoid shattering or severe deformation when the structure impacts an obstruction in a tubing, will allow for phasing of capsule charges mounted thereon, and yet will shatter when the charges in the gun detonate. The new perforating gun is rugged, that is, one which will not become stuck or will not shatter in a tubing when an obstruction is impacted, one which has good penetration of the formation due to its use of capsule (sealed) shape charges, one which phases its charges along at least two directions, and one which does not require an increased diameter tubing string.

However, the base strip of the prior application, on which the charges are mounted, is designed to shatter when the charges detonate; therefore, one cannot determine which charges detonated and which charges did not detonate. In some situations, it may be necessary to determine which charges on the base strip detonated, or which ones did not detonate. Therefore, in order to determine which charges detonated, the base strip should not shatter when the charges detonate, although the charges themselves should be allowed to fall to the bottom of the well following detonation. As a result, following detonation, the base strip may be retrieved for subsequent inspection to determine which charges detonated.

SUMMARY OF THE INVENTION

Accordingly, it is a primary object of the present invention to provide a perforating gun having phased capsule charges, adapted to be lowered into a tubing string disposed in a borehole, where the perforating gun includes a base strip, a plurality of the capsule charges, and a corresponding plurality of support rings connected to the base strip in a phased manner for mounting the capsule charges to the base strip, the base strip being designed to withstand detonation of the capsule charges and will not shatter when the charges detonate, the support rings being designed to shatter in response to detonation of the capsule charges.

In accordance with this and other objects of the present invention, a through-tubing perforating gun, including a plurality of phased capsule charges, comprises a base strip having an angular cross sectional configuration thereby allowing the charges to be phased when connected thereto, and a plurality of support rings connected to the base strip and adapted for mounting the capsule charges to the base strip so as to phase the capsule charges, the base strip itself being made of a specific material which will withstand detonation of the charges and will not shatter when the charges detonate. However, each of the support rings are made of a material which will shatter when the charges mounted therein detonate thereby allowing the capsule charges to fall to the bottom of the well. Since the base strip did not shatter, it may be retrieved for subsequent inspection to determine which capsule charges detonated and which charges did not detonate.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 5 illustrates another prior art embodiment of a phased, non-capsule charge perforating gun;

FIG. 6 illustrates the phased capsule charge perforating gun in accordance with the present invention; and FIGS. 7*a* through 7*c* illustrate other views of the phased capsule charge perforating gun of FIG. 6 in accordance with the present invention.

DETAILED DESCRIPTION OF THE PREFERRED EMBODIMENT

In any perforating gun, it is important that the gun be rugged, that is, it will not become stuck in a tubing during operation. If a gun is not rugged, and is broken or otherwise severely deformed during operation, it is possible that live charges from the gun may become stuck in the tubing. Such charges must be recovered (salvaged) at considerable expense. During this salvaging operation, there is a risk that the charges will detonate at the wrong depth of the well. A superior perforating gun is one which: (1) upon firing, penetrates the formation over a distance greater than the penetration distance associated with any other gun of the same diameter, (2) phases the charges in the gun, and (3) is rugged and durable enough to traverse the wellbore without fracturing or becoming stuck in the wellbore. Some prior art guns, e.g., the strip type gun, are rugged (will not become stuck in the well) and has a good penetration distance, but the charges in this gun are not phased. Other prior art guns, e.g., the hollow carrier type gun, are rugged and the charges are phased, but the penetration distance associated with this other type of prior art perforating gun is lower than that of other guns of the same diameter. For example, in the hollow carrier type gun, the hollow carrier requires a charge of reduced size; the reduced size charge produces a lower penetration distance for a given gun diameter. The perforating gun of the present invention is designed to provide optimum penetration distance, charge phasing and the required ruggedness.

Figure 1A:
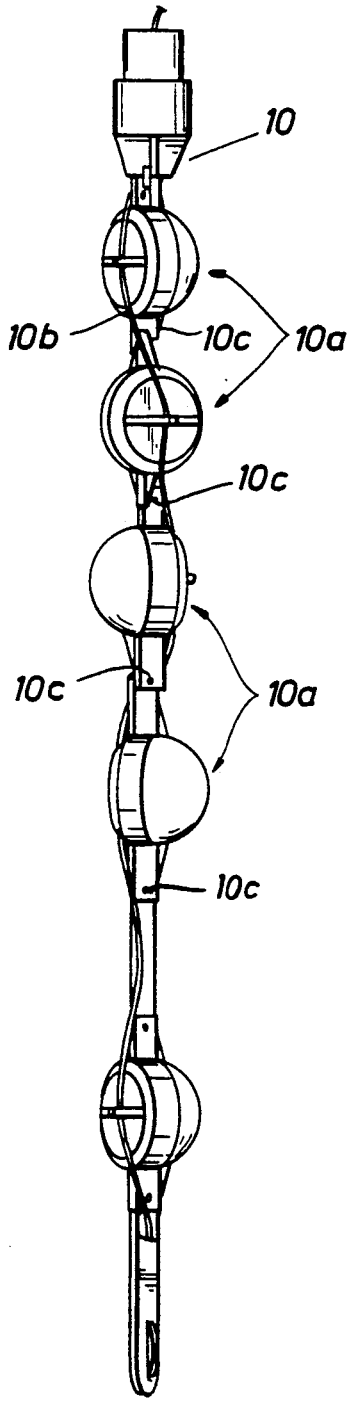
FIG. 1a (PRIOR ART)
FIGS. 1*a* and 1*b* illustrate the prior art capsule and link type fully expendable perforating guns.
Figure 1B:
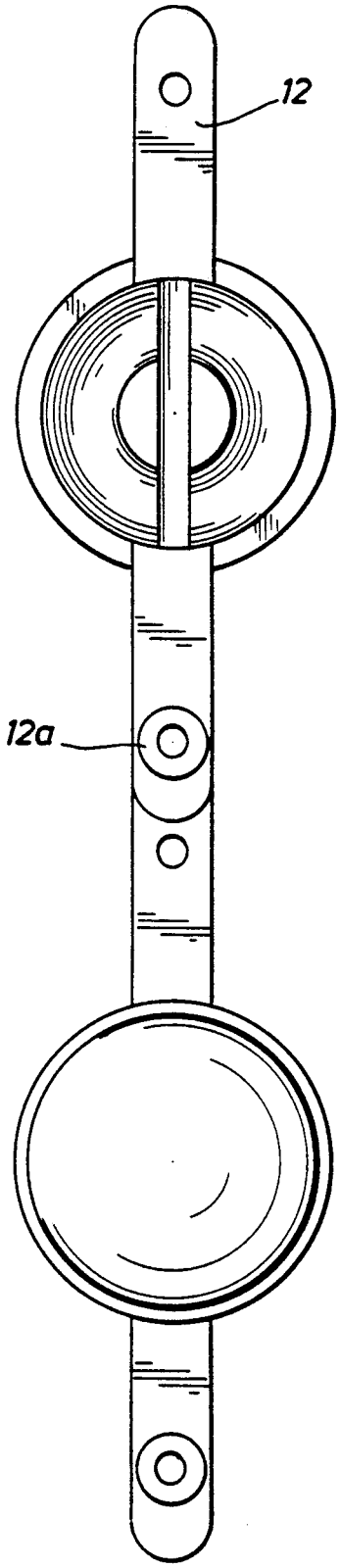
FIG. 1b (PRIOR ART)

Referring to FIGS. 1*a* and 1*b*, prior art embodiments of perforating guns are illustrated.

In FIGS. 1*a* and 1*b*, capsule or link type fully expendable prior art guns are illustrated. In FIG. 1*a*, gun 10 is a prior art capsule charge type gun, the capsule charges being phased (pointed in different directions) in order to perforate the formation along a 360 circumference. A capsule (exposed) charge should be distinguished from normal (hollow carrier "protected") charges in that capsule charges are sealed charges, sealed against hostile ambient temperatures and pressures normally found in oil well boreholes. Normal charges are not sealed; therefore, a carrier tube must encompass the normal charges in order to protect the charges from the hostile borehole temperatures and pressures. Gun 10 includes a plurality of capsule charges 10*a* which are phased, that is, each charge is pointed in a different direction. A primer cord 10*b* weaves around each charge for detonating the charge in response to a detonation stimulus. Each charge is connected to the next, adjacent charge via cotter pins 10*c*. When the gun 10 is lowered into the borehole or tubing, an impact with a borehole or tubing obstruction often breaks the cotter pins. Therefore, the base strip of gun 10, on which the capsule charges 10*a* are mounted, is not rigid or rugged enough to withstand the impact with the borehole or tubing obstruction. In FIG. 1*b*, gun 12 includes a plurality of capsule charges which are phased and which are connected to each other via rivets 12*a*. The rivets 12*a* of gun 12 also break when the gun impacts an obstruction in the borehole. Since gun 10 and gun 12 are put together with cotter pins or rivets, the base strip on which the charges mount is not a single, unitary structure. This non-unitary structure detracts from the ruggedness of the guns 10 and 12.

Figure 2A:
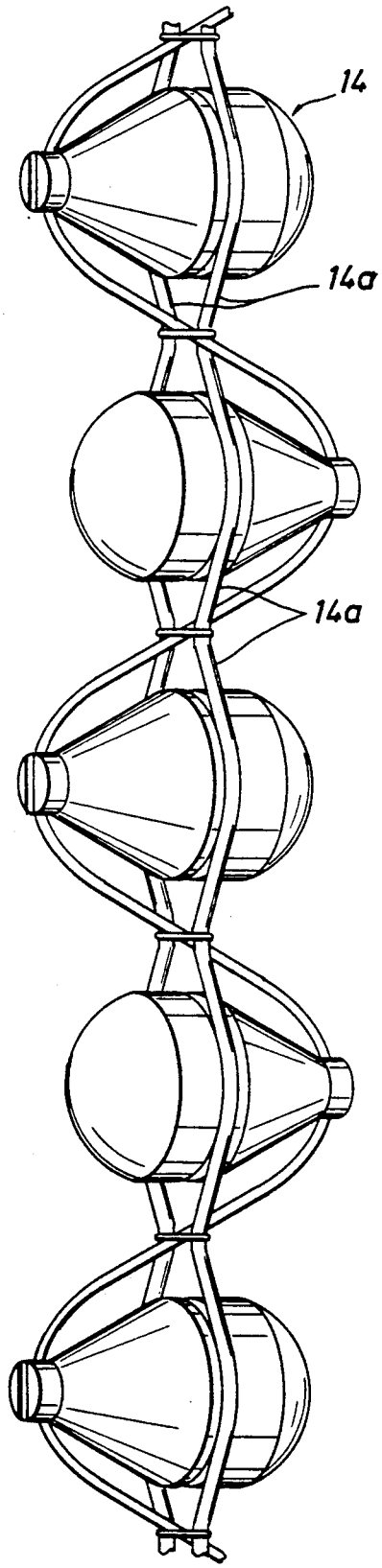
FIG. 2a (PRIOR ART)
FIGS. 2*a* and 2*b* illustrate the prior art wire and strip type semi-expendable guns.
Figure 2B:
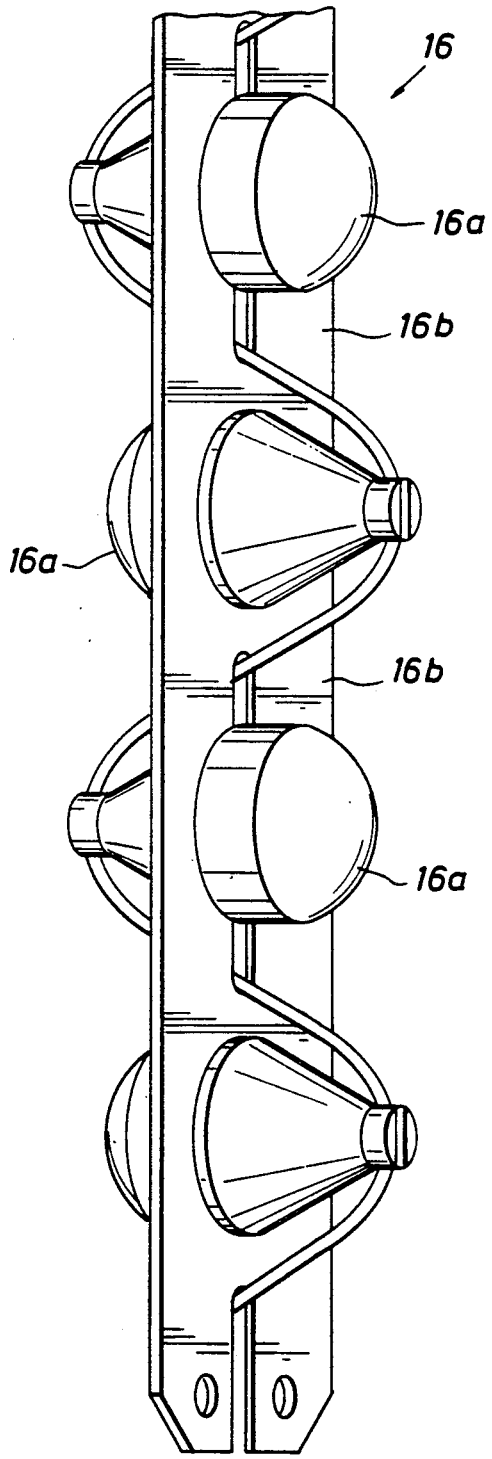
FIG. 2b (PRIOR ART)

In FIGS. 2*a* and 2*b*, prior art embodiments of wire or strip type semi-expendable perforating guns are illustrated. Gun 14 of FIG. 2*a* includes a plurality of phased capsule charges connected together by wires 14*a*. When gun 14 is lowered into a borehole, the wires 14*a*, being so small and relatively brittle, break upon impact with an obstruction in the borehole. Gun 16 of FIG. 2*b* includes a plurality of capsule charges 16*a* mounted on a rigid base structure 16*b*. While the base structure 16*b* is rigid, the charge diameter is restricted by the rigid base (which means reduced penetration); the base, being a thin sheet metal with large holes, bends easily and is not so rigid; and the base does not shatter in response to detonation of charges (long pieces of the base survive the discharge).

Figure 3:
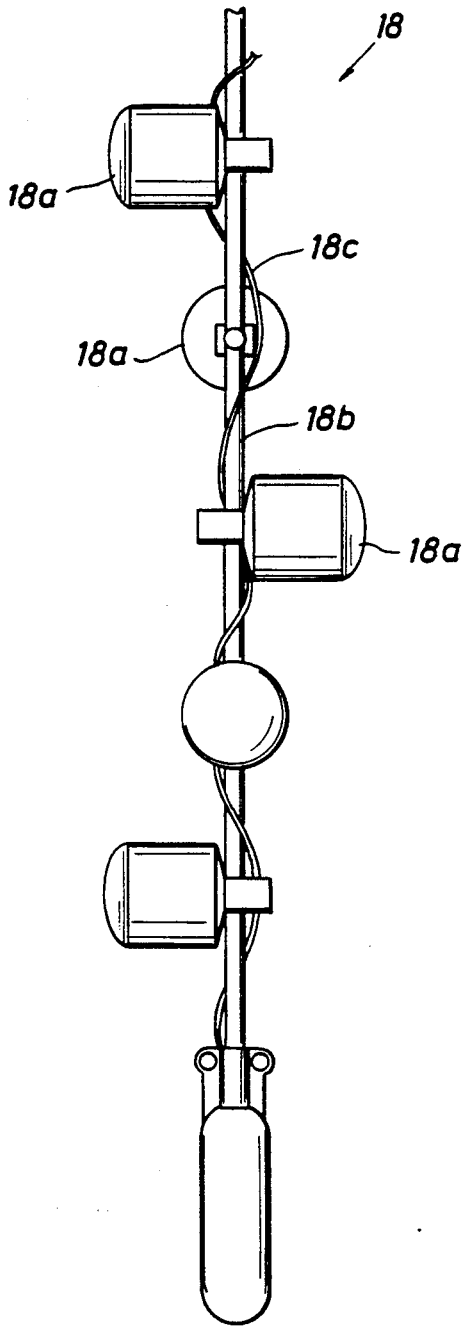
FIG. 3 (PRIOR ART)
FIG. 3 illustrates another prior art embodiment of a capsule type, phased, large diameter perforating gun.

Referring to FIG. 3, another prior art embodiment of a perforating gun is illustrated.

In FIG. 3, a perforating gun 18 includes a plurality of capsule charges 18*a* mounted on a straight, relatively rigid base strip 18*b*. The base structure 18*b* may be hollow, allowing a primer cord to be inserted through the center thereof for connection to each of the charges 18*a*. In FIG. 3, the primer cord wraps around the base strip 18*b*. The problem with this embodiment is the size or diameter of the gun 18. Relative to the prior art embodiments of FIGS. 1 and 2, the diameter of the gun is greatly increased with respect to the diameter of the guns 10, 12, 14, and 16.

Figure 4:
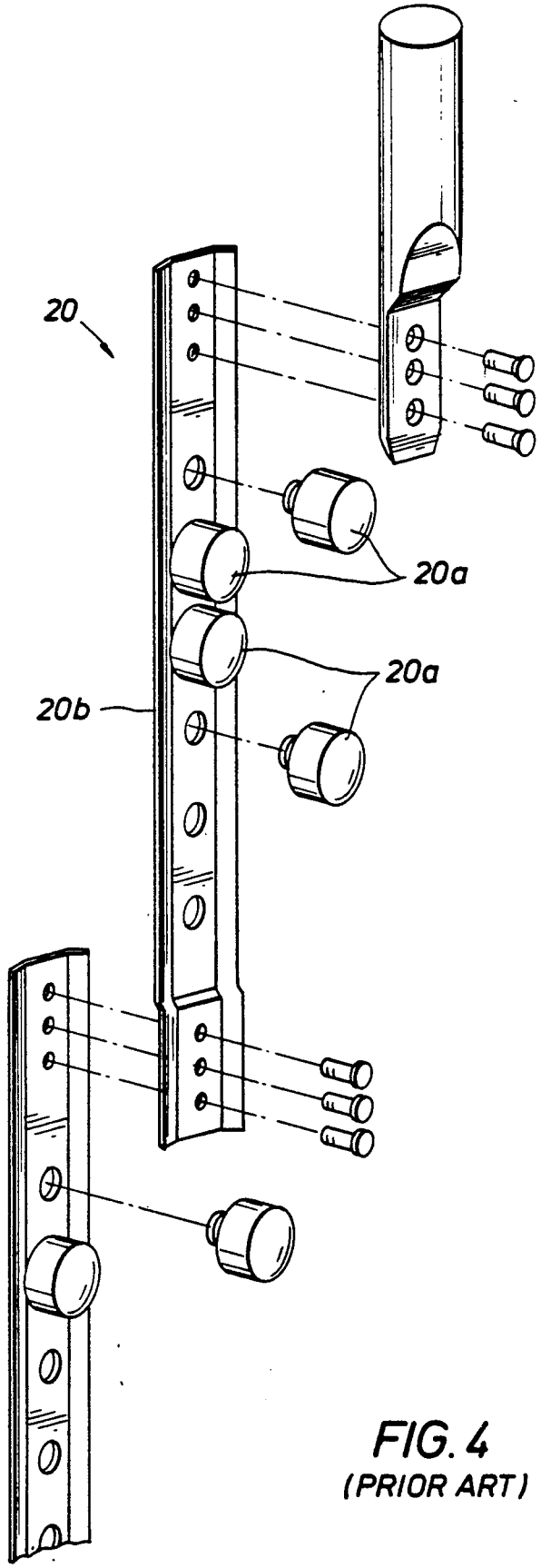
FIG. 4 (PRIOR ART)
FIG. 4 illustrates another prior art embodiment of a capsule charge, non-phased perforating gun.

Referring to FIG. 4, another prior art embodiment of a perforating gun is illustrated.

In FIG. 4, a gun 20 includes a plurality of capsule charges 20*a* mounted on a rigid base strip 20*b* which consists of a metallic strip having a plurality of holes disposed therethrough for connection to the corresponding plurality of capsule charges 20*a* as indicated in the drawing. However, gun 20 and, in particular, the base strip 20*b*, is not designed in a way which would allow the charges 20*a* to be phased, that is, pointed in different directions, in order to permit perforation along a 360 degree circumference in the borehole. The metallic strip 20*b* is not constructed and designed in a manner which, when the charges are mounted on the strip, would allow the charges to be phased.

Referring to FIG. 5, another prior art embodiment of a perforating gun is illustrated.

In FIG. 5, a phased, non-capsule charge perforating gun 22 is shown to include a base strip 22*a*, a plurality of normal, non-sealed charges inserted in the base strip 22*a*, and a carrier tube 22*b* enclosing and protecting the base strip 22*a* and its normal non-sealed charges. The base strip 22*a* consists of a tube having a plurality holes 22*a*1 disposed therethrough, the holes 22*a*1 allowing a corresponding plurality of non-capsule charges (normal, non-sealed charges) to be inserted therein. Since the normal charges are not sealed, the carrier tube 22*b* must enclose the base structure 22*a* and the normal, non-sealed charges. As a result, the normal non-sealed charges will be protected from the hostile ambient borehole temperatures and pressures. The problem with this embodiment, however, is the fact that the charges are not sealed. This requires an additional structure not present in the other prior art embodiments mentioned hereinabove, the additional structure being a carrier tube for protecting the charges from the hostile temperatures and pressures present in a borehole environment.

Referring to FIG. 6, a phased capsule charge perforating gun 24 in accordance with the present invention is illustrated.

In order to remedy some of the deficiencies present in the prior art perforating guns referenced herinabove, the assignee of this application designed, and disclosed in a prior application identified below, a new through-tubing perforating gun which includes capsule charges (no carrier tube is needed) and a base strip for mounting the charges, the base strip having a cross sectional configuration designed to phase the capsule charges and being strong enough to withstand an impact with an obstruction in a tubing yet will shatter when the charges mounted on the base strip detonate. The new perforating gun has a reduced diameter which allows the gun to be inserted into a tubing string disposed in a borehole. This new through-tubing perforating gun is fully disclosed in prior application Ser. No. 07/394,782, filed Aug. 16, 1989, and now U.S. Pat. No. 4,951,744, entitled "Angularly Shaped Unitary Structured Base Strip Comprised of a Specific Material adapted for Phasing Charges in a Perforating Gun", the disclosure of which is incorporated by reference into this specification. However, although the charges fall to the bottom of the well following detonation, since the base strip itself shatters following detonation and also falls to the bottom of the well, one cannot determine which charges on the base strip detonated and which charges did not detonate. Occasionally, it may be necessary to determine which capsule charges on the base strip detonated and which charges did not detonate.

In FIG. 6, in accordance with the present invention, a further new perforating gun 24 includes a base strip 24*a*, a plurality of capsule charges 24*b* and a corresponding plurality of support rings 24*c* each adapted to be connected to the base strip 24*a* for holding the charges 24*b* in place onto a surface of the base strip 24*a*. The base strip 24*a* is a single unitary structure and includes a first surface 24*a*2 lying in a first plane and a second surface 24*a*3 connected to and substantially coextensive with the first surface and lying in a second plane which is different than the first plane, the unitary structure of the first and second surfaces 24*a*2 and 24*a*3 providing structural support and resistance to bending action to each other. The plurality of capsule charges 24*b* are alternately connected to the first and second surfaces 24*a*2 and 24*a*3 of the base strip 24*a*; that is, a first capsule charge 24*b* is held in place onto the first surface 24*a*2 of the base strip 24*a* by a first support ring 24*c*; a second capsule charge 24*b* is held in place onto the second surface 24*a*3 of the base strip 24*a* by a second support ring 24*c*; a third capsule charge 24*b* is held in place onto the first surface 24*a*2 of the base strip 24*a* by a third support ring 24*c*, etc. The base strip 24*a* includes a plurality of recesses 24*a*1 alternately carved into the first and second surfaces 24*a*2 and 24*a*3, respectively, each recess 24*a*1 on a surface 24*a*2 or 24*a*3 of the base strip 24*a* being shaped to accomodate the circumferential shape of a capsule charge 24*b* when the capsule charge 24*b* is held in place onto an opposing surface of the base strip by a support ring 24*c*. As illustrated again in FIG. 7*b*, a base 24*b*1 of each capsule charge 24*b* hangs over the edge of its respective first or second surface 24*a*2 or 24*a*3. The base strip 24*a* is made of a special material which will allow the base strip to withstand the detonation of the capsule charges 24*b*; that is, the base strip 24*a* will not shatter when the charges 24*b* detonate. However, it is still desirable and necessary to allow the charges 24*b* to fall to the bottom of a borehole when the charges detonate. Therefore, the plurality of charges 24*b* are each mounted onto base strip 24*a* by a corresponding plurality of support rings 24*c*. The support rings 24*c* are each physically connected to the base strip 24*a* by a pair of screws, the support rings 24*c* holding the charges 24*b* physically within their respective recesses 24*a*1. However, in order to allow the charges 24*c* to fall to the bottom of the borehole following detonation, each of the support rings 24*c* are also made of another special material which will allow the support rings 24*c* to shatter into a multitude of pieces when their respective charges detonate. Therefore, following detonation of the perforating gun, the support rings 24*c* shatter into a multitude of pieces thereby allowing their respective charges 24*b* to fall to the bottom of the borehole; however, the base strip 24*a* itself withstands detonation of the charges 24*b* and will not shatter when the charges 24*b* detonate. The base strip 24*a* may be subsequently retrieved from the borehole; an inspection of the base strip 24*a* reveals the identity of those charges 24*b* which detonated and those which did not detonate, since the base strip 24*a* will be deformed slightly near those recesses 24*a*1 of the base strip 24*a* where the charges 24 detonated.

The base strip 24*a* is comprised of 4140 steel at 26–32 Rc (Rockwell scale c) hardness. The 26–32 Rc hardness is optimum for the base strip 24*a* since the 4140 steel is able to withstand high amounts of shock without deforming (i.e., when the shape charges connected to the base strip 24a detonate). If the base strip 24a were heat treated much higher than 32 Rc hardness, the base strip would increase in strength, but it would become brittle and could fracture much easier under impact, whereas, a lower heat treat (below 26 Rc) makes the material of the base strip weaker. Furthermore, the designation 4140 refers to the specific type of composition of the metal according to specifications published by the American Iron and Steel Institute. The first two digits of the number 4140 (i.e., "41") can be decoded to determine the nominal alloy content. For example, 41XX means that the steel contains between 0.50% and 0.95% chromium and between 0.12% and 0.30% molybdenum. Since the 4140 steel contains chromium and molybdenum, it is considered an alloy steel. The last two digits of the number ("XX") indicate the carbon content of the steel in hundredths of a percent. Therefore, the 4140 steel contains 0.40% carbon.

The support rings 24c are each comprised of 1020 mild steel. The first two digits "10" of 1020 signifies that it is plain carbon steel (i.e., contains no alloys such as nickel, chromium and molybdenum). The last two digits "20" of 1020 indicate the carbon content of the steel in hundredths of a percent, i.e., 0.20% carbon. The softer metals, such as the 1020 mild steel, are usually measured on a Brinell hardness scale. The 1020 steel does not have enough carbon in it to be heat treated and, as a result, it is a relatively soft steel; however, if it was to be measured, it would be in the Brinell hardness range of approximately 115 Hb. The steel 1020 is used for the support rings 24c since it is relatively weak compared to heat treated 4140 steel of the base strip. The advantage of this property is that the 1020 steel of the support rings 24c will break apart and shatter into small pieces when the shape charges detonate thereby leaving small debris in the well and minimizing the energy transfer from the charges to the base strip.

Referring to FIGS. *7a–7c*, other views of the phased capsule charge perforating gun 24 of FIG. 6 are illustrated.

In FIG. *7a*, the capsule charges 24b are again shown mounted, in a phased manner, to the base strip 24a via the plurality of support rings 24c. A detonating cord 26 is connected to each charge 24b for providing a detonating wave to the charges thereby detonating the charges. As shown in FIG. *7a*, a first capsule charge 24b is mounted to the second surface 24a3 of base strip 24a via a first support ring 24c; a second capsule charge 24b is mounted to the first surface 24a2 of the base strip 24a via a second support ring 24c; a third capsule charge 24b is mounted to the second surface 24a3 of the base strip 24a via a third support ring 24c, etc.

In FIG. *7b*, a cross sectional view of the actual mounting or connection of the capsule charge 24b to base strip 24a via support ring 24c is illustrated. In FIG. *7b*, a charge 24b is mounted to base strip 24a via support ring 24c. The circumferential shape of the capsule charge 24b is disposed in the recess 24a1 of the base strip 24a. The base 24b1 of the capsule charge 24b hangs over the edge of the first or second surface 24a2 or 24a3 of base strip 24a. The support ring 24c includes a ring section 24c1 and a leg section 24c2 having one end integrally connected to the ring section 24c1. The leg section 24c2 has an opposite end *c2a* adapted to be connected to the first or section surface 24a2 or 24a3 of base strip 24a, the opposite end *c2a* being angularly shaped to conform to the angular shape of the base strip 24a.

In FIG. *7c*, a further view of solely the support ring 24c is illustrated, this further view again illustrating the ring section 24c1, the leg section 24c2, and the opposite end *c2a* of the leg section 24c2.

The perforating gun of the present invention, as illustrated in FIG. 6, solves all the problems associated with the prior art perforating guns illustrated in FIGS. 1–5 and referenced in this application; and it also provides an additional advantage not present with respect to the perforating gun of assignee disclosed in the prior application Ser. No. 07/394,782, filed Aug. 16, 1989, and now U.S. Pat. No. 4,951,744, referenced hereinabove, that is, the base strip 24a will not shatter when the charges detonate and will withstand the detonation, yet the charges 24b will fall to the bottom of the borehole when the charges detonate since each of the support rings 24c shatter in response to detonation of the charges 24b. Since the base strip 24a does not shatter, it may be retrieved from the borehole and inspected to determine the identity of those charges 24b which detonated and those which did not detonate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A perforating gun, comprising:

a base strip being a single unitary structure and including a first surface lying in a first plane and a second surface connected to and substantially coextensive with said first surface and lying in a second plane which is different than said first plane;

a first plurality of charges adapted for detonating in response to an input stimulus;

a second plurality of charges adapted for detonating in response to the input stimulus;

a first plurality of holding means for holding said first plurality of charges in place on said first surface of said base strip; and a second plurality of holding means for holding said second plurality of charges in place on said second surface of said base strip, said base strip remaining intact and not shattering when said first and second plurality of charges detonate, said holding means shattering when said first and second plurality of charges detonate.

2. The perforating gun of claim 1, wherein said first surface of said base strip includes a first plurality of recesses, the second surface of said base strip including a second plurality of recesses.

3. The perforating gun of claim 2, wherein said second plurality of charges are received in said first plurality of recesses in said first surface of said base strip when said second plurality of holding means holds said second plurality of charges on said second surface of said base strip.

4. The perforating gun of claim 3, wherein said first plurality of charges are received in said second plurality of recesses in said second surface of said base strip when said first plurality of holding means holds said first plurality of charges on said first surface of said base strip.

5. The perforating gun of claim 4, wherein said first and second plurality of holding means each comprise a support ring, the support ring surrounding a charge and holding said charges onto the first or second surface of said base strip.

6. The perforating gun of claim 5, wherein said base strip is comprised of a first material, the first material being steel having a 26–32 Rc hardness.

7. The perforating gun of claim 6, wherein each said support ring is comprised of a second material, the second material being mild steel.

* * * * *